US005905932A

United States Patent [19]

Morse et al.

[11] Patent Number: 5,905,932

[45] Date of Patent: May 18, 1999

[54] METHOD AND APPARATUS FOR THE REMOVAL OF TONER AND MAGNETIC CARRIER PARTICLES FROM A SURFACE

[75] Inventors: Theodore H. Morse, Rochester; Kenneth J. Brown, Penfield; David L. Thompson, Henrietta, all of N.Y.

[73] Assignee: Eastman Kodak Company, Rochester, N.Y.

[21] Appl. No.: 09/053,504

[22] Filed: Apr. 4, 1998

[51] Int. Cl.[6] ..... G03G 21/00

[52] U.S. Cl. ..... 399/353; 15/1.51; 399/349

[58] Field of Search ..... 399/353, 356, 399/350, 349; 15/1.51, 256.5

[56] References Cited

U.S. PATENT DOCUMENTS

| | | | |
|---|---|---|---|
| 4,095,980 | 6/1978 | Satomi | 399/353 X |
| 4,097,140 | 6/1978 | Suzuki et al. | 399/353 |
| 4,127,327 | 11/1978 | Rezanka . | |
| 4,263,390 | 4/1981 | Yamashita et al. . | |
| 4,319,831 | 3/1982 | Matsui et al. . | |
| 4,402,103 | 9/1983 | Yanagawa et al. | 399/356 X |
| 4,506,975 | 3/1985 | Shukuri et al. . | |
| 4,530,597 | 7/1985 | Itaya et al. . | |
| 4,618,250 | 10/1986 | Noguchi et al. | 399/356 X |
| 4,664,505 | 5/1987 | Itaya et al. . | |
| 4,706,320 | 11/1987 | Swift . | |
| 4,786,943 | 11/1988 | Fukae et al. . | |
| 4,835,807 | 6/1989 | Swift . | |
| 4,994,863 | 2/1991 | Reynolds . | |
| 5,084,735 | 1/1992 | Rimai et al. . | |
| 5,187,526 | 2/1993 | Zaretsky . | |
| 5,196,887 | 3/1993 | Hilbert et al. . | |
| 5,212,530 | 5/1993 | Harada et al. | 399/349 |
| 5,282,008 | 1/1994 | Ellingham et al. | 399/356 |
| 5,370,961 | 12/1994 | Zaretsky et al. . | |
| 5,416,572 | 5/1995 | Kolb et al. | 399/350 |
| 5,600,405 | 2/1997 | Umeda et al. . | |
| 5,689,791 | 11/1997 | Swift . | |

FOREIGN PATENT DOCUMENTS

| | | |
|---|---|---|
| 52-13343 | 2/1977 | Japan . |
| 56-149078 | 11/1981 | Japan . |
| 61-73984 | 4/1986 | Japan . |
| 1-116678 | 5/1989 | Japan . |
| 4-93974 | 3/1992 | Japan . |
| 5-188836 | 7/1993 | Japan . |

*Primary Examiner*—S. Lee
*Attorney, Agent, or Firm*—Norman Rushefsky

[57] ABSTRACT

An electrostatographic reproduction apparatus and method for cleaning remnant toner and carrier particles. A fiber cleaning brush includes plural individual conductive brush fibers in engagement with a toner bearing member to remove residual toner and magnetic carrier particles from the member. A detoning roller includes an electrically conductive surface that contacts the brush fibers and is electrically biased to electrostatically remove toner particles from the fiber brush. The detoning roller includes one or more permanent magnets for attracting remnant carrier to the detoning roller. A skive blade of non-magnetic material engages the detoning roller. In some embodiments, the permanent magnet is stationary and provides substantially no magnetic field where the skive blade engages the detoning roller to avoid congregation of magnetic carrier particles adjacent the edge of the blade. In another embodiment, the magnet rotates to cause carrier particles to move along the blade. In all embodiments, most of the carrier particles never reaches the blade to reduce the wear on the blade edge.

21 Claims, 8 Drawing Sheets

METHOD AND APPARATUS FOR THE REMOVAL OF TONER AND MAGNETIC CARRIER PARTICLES FROM A SURFACE

CROSS-REFERENCE TO RELATED APPLICATIONS

This application is related to U.S. application Ser. No. 08/905,793, filed Jul. 28, 1997 by J. Maher et al and entitled "Conductive Cleaning Brush and Method of Cleaning" and to U.S. application Ser. No. 08/901,513, filed Jul. 28, 1997 by Maher et al and entitled "Method and Apparatus for Cleaning Remnant Toner and Carrier Particles".

FIELD OF THE INVENTION

The present invention relates to electrostatographic reproduction apparatus and methods and in particular to cleaning remnant toner and magnetic carrier particles in such apparatus.

DESCRIPTION RELATIVE TO THE PRIOR ART

In electrostatographic reproducing apparatus commonly used today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image contained within the original document. Alternatively, in an electronic exposure system a light beam may be modulated and used to selectively discharge portions of the charged photoconductive surface to record the desired information thereon. Typically, such a system employs a laser beam or LED printhead. Subsequently, the electrostatic latent image on the photoconductive insulating surface is made visible by developing the image with developer powder referred to in the art as toner. Most development systems employ developer which comprises both electrostatically charged magnetic carrier particles and electrostatically charged toner particles. The toner particles triboelectrically adhere to the carrier particles. During development, the toner particles are attracted from the carrier particles by the charged pattern of the image areas of the photoconductive insulating area to form a powder image on the photoconductive area. This toner image may be subsequently transferred to a support surface such as copy paper to which it may be permanently affixed by heating or by the application of pressure. For enhanced image reproduction and in respect to color reproducing apparatus, it is known to transfer the toner image to an intermediate transfer member and then to the copy paper or other receiver sheet.

Commercial embodiments of the above general processor have taken various forms and in particular various techniques for cleaning the photoreceptor have been used. Additionally, cleaning of the intermediate transfer member (ITM) involves unique challenges since the preferred ITMs tend to be semiconductive whereas the photoconductors are, as noted above, insulative.

In the prior art, the use of fiber brushes has been relatively standard. The bristles of the fiber brush are rotated in close proximity to the surface to be cleaned so that the fibers continually wipe across the surface to produce the desired cleaning. U.S. Pat. No. 4,097,140 (Suzuki et al) discloses the use of a fiber cleaning brush for removing residual toner of the single component magnetic type from a surface. The patent notes that no electrostatic field is necessary for removing such particles. In U.S. Pat. No. 4,835,807 (Swift), it is noted that in addition to relying on the physical contacting of the surface to be cleaned, an electrostatic field may be used to electrically bias the brush to establish a field between the conductive brush and the insulating imaging surface so that the toner on the imaging surface is attracted to the brush. In Swift, the individual fibers of the brush comprise a nylon filamentary polymer substrate that has finely divided electrically conductive particles of carbon black suffused through the surface of the polymer substrate and thus are present inside the fiber as a uniformly dispersed phase in an annular region located at the periphery of the filament and extending inwardly and along the length of the fiber. The amount of suffused carbon black particles is such as to render the electrical resistance of the fibers from about $1\times10^3$ ohms/cm to about $1\times10^9$ ohms/cm. The Swift patent discloses that the individual fibers have preferably a non-conductive core with a thinner outer portion of conductive carbon although, while not preferred, the core may be conductive.

Matsui et al also discloses a cleaning brush comprised of conductive fibers. In Matsui, it is noted that durability of the cleaning device can be greatly improved by using conductive composite fibers containing conductive fine particles. While fibers with conductive cores are disclosed by Matsui, they are again not considered to be preferred as they are deemed to be poor in preventing of toner from sticking. In the cleaning brushes described by Matsui, a metal roller or drum is provided and a knit including the conductive fibers is wound about the drum and bonded to the drum with an adhesive. In use, the metal drum is grounded thereby grounding the filaments.

A problem associated with fiber cleaning brushes of the prior art is that if the periphery of the fiber is made conductive, then breaking off of fibers can cause electrical shorts to develop in the machine where the fibers land. An additional problem with such fiber cleaning brushes is that cleaning of the brush itself becomes a problem. In the prior art as taught by Swift, an electrically-biased detoning roller is associated with the cleaning brush for removing toner from the brush. The detoning roller is electrically biased to a higher voltage level and of the same polarity as the cleaning brush. However, where the brush fibers are conductive at the periphery, the detoning roller is required to have an insulating coating which contacts the fibers to maintain an electrical field for attracting toner from the brush to the detoning roller. The addition of an insulating layer on the detoning roller such as a metal oxide represents an added expense to the cost of the roller and is relatively more difficult to clean than a highly polished metal surface.

An additional problem is presented with regard to removing magnetic carrier particles which have escaped the development station and are carried to a toner image-bearing member.

In the referenced related applications, there is disclosed an improved method and apparatus for removing a remnant toner image from a toner image bearing member. In this improved method and apparatus, a fiber cleaning brush rotates so as to scrub the member to remove remnant toner particles as well as any magnetic carrier particles that may have escaped the development station. The fibers are formed of filaments that have a conductive core upon which an electrical bias may be impressed to attract toner to the brush. A rotating detoning roller having an electrically conductive surface is in contact with the fibers of the fiber brush. The detoning roller's surface is electrically biased to electrostatically, attract toner in the brush onto the surface of the detoning roller. Magnets in the detoning roller core are provided to magnetically attract magnetic carrier particles in the brush to the surface of the detoning roller. A skive blade made of magnetic material such as steel engages the detoning roller's surface to remove toner particles and carrier particles from the surface. The magnets in the core of the detoning roller also attract the skive blade into intimate contact with the detoning system.

While the apparatus with the conductive core fibers works well, a problem has been noted in that the edge of the skive blade tends to wear and thus must be replaced more often than is desirable. If such frequent replacement is not made, incomplete toner removal from the detoning roller occurs and reduced cleaning of the cleaning brush results thereby affecting adversely the cleaning of the toner image bearing member. In analyzing the problem of premature wear, it was noted by the inventors that such wear appears to be due to congregation of magnetic carrier particles at the working edge of the skive blade. These particles are not completely removed from the detoning roller surface by the skive, as would be expected. With rotation of the detoning roller surface, the iron carrier particles are agitated in the area of the edge of the skive blade and over time cause the edge to wear prematurely.

It is therefore an object to the invention to improve the performance of the cleaning apparatus described above.

These and other objects and advantages will become more apparent after a reading of the detailed description provided below.

SUMMARY OF THE INVENTION

In accordance with a first aspect of the invention, there is provided an electrostatographic reproduction apparatus comprising a toner-bearing member supporting a remnant of a toner image of insulative toner particles and also supporting a minor amount relative to the amount of toner particles in the remnant image of escaped magnetic carrier particles; and a cleaning apparatus including a fiber cleaning brush including fibers in contact with the toner bearing member and scrubbing the member to remove remnant toner particles and carrier particles, a rotating detoning roller having an electrically conductive surface in contact with the fibers of the fiber brush, the detoning roller including a first permanent magnet located beneath the conductive surface for providing a magnetic field where the fibers engage the detoning roller and attracting escaped carrier particles to the detoning roller, an electrical bias on the conductive surface of the detoning roller for electrostatically attracting toner particles to the conductive surface, a skive blade of substantially non-magnetic material, the skive blade engaging the conductive surface at a location remote from where the fibers engage the detoning roller.

In accordance with a second aspect of the invention, there is provided a cleaning method for use in an electrostatographic reproduction apparatus, the method comprising providing a toner image bearing member supporting a remnant of a toner image including insulative toner particles and a minor amount relative to the amount of toner particles in the remnant image of magnetic carrier particles; scrubbing the member to remove remnant toner particles and carrier particles with a fiber cleaning brush including fibers in contact with the toner image bearing member; rotating a detoning roller having a rotating surface in contact with the fibers of the fiber brush, the detoning roller including a first permanent magnet located beneath the surface and attracting escaped carrier particles to the detoning roller's surface; establishing an electrical bias that electrostatically attracts toner particles to the detoning roller's surface; biasing a skive blade of non-magnetic material into engagement with the detoning roller's surface, the skive blade removing toner particles and carrier particles from the detoning roller's surface.

In accordance with a third aspect of the invention, there is provided an electrostatographic reproduction apparatus comprising a toner-bearing member supporting a remnant of a toner image of insulative toner particles and also supporting a minor amount relative to the amount of toner particles in the remnant image of escaped magnetic carrier particles; and a cleaning apparatus including a fiber cleaning brush including fibers in contact with the toner bearing member and scrubbing the member to remove remnant toner particles and carrier particles, a rotating detoning roller having a surface in contact with the fibers of the fiber brush, the detoning roller including a stationary permanent magnet located beneath the surface for providing a magnetic field where the fibers engage the detoning roller and attracting escaped carrier particles to the detoning roller, an electrical field for electrostatically attracting toner particles to the surface, a skive blade of substantially non-magnetic material, the skive blade engaging the surface at a location remote from where the fibers engage the detoning roller and wherein the magnetic field strength at the location where the skive blade engages the surface is substantially lower than the magnetic field strength where the fibers contact the surface.

BRIEF DESCRIPTION OF THE DRAWINGS

In the detailed description of the preferred embodiments of the invention presented below, reference is made to the accompanying drawings in which.

DETAILED DESCRIPTION OF THE PREFERRED EMBODIMENTS

The preferred embodiments are described herein with reference to an electrophotographic copier or printer, but it will be understood that the invention can be used in any form of black and white or color electrostatographic copier or printer including electrographic copiers or printers. The description will be directed in particular to elements forming part of, or cooperating more directly with, the method in accordance with the present invention. It is to be understood that elements not specifically shown or described may take various forms well known to those skilled in the art.

Figure 1:
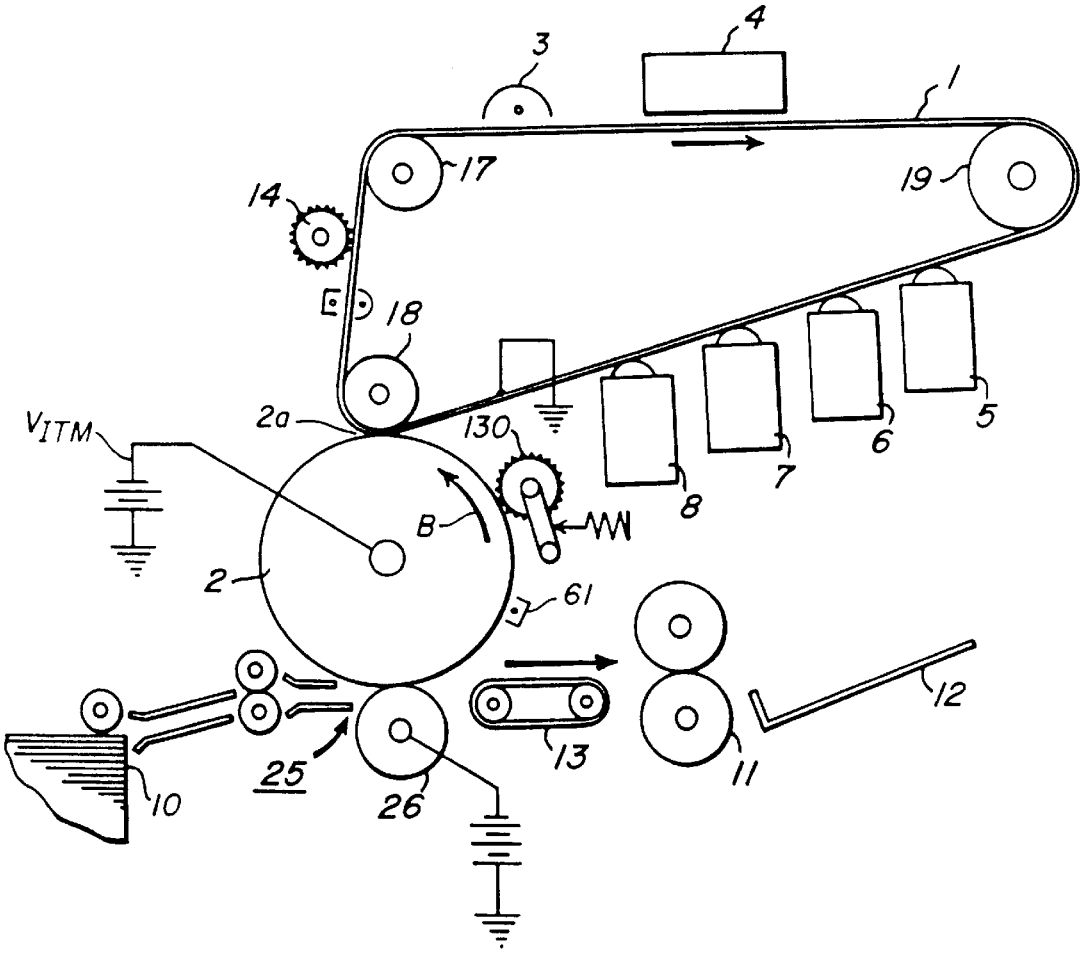
FIG. 1 is a side elevation schematic of a color printer apparatus utilizing a cleaning apparatus of the invention.

FIG. 1 illustrates an apparatus in which the invention may be used. A primary image member, for example, a photoconductive web 1 is trained about rollers 17, 18 and 19, one of which is drivable to move image member 1 past a series of stations well known in the electrophotographic art. Primary image member 1 is uniformly charged at a charging station 3, imagewise exposed at an exposure station 4, e.g., an LED printhead or laser electronic exposure station to create an electrostatic image. The image is toned by one of toner or development stations 5, 6, 7 or 8 to create a toner image corresponding to the color of toner in the station used. The toner image is electrostatically transferred from primary image member 1 to an intermediate transfer member, for example, intermediate transfer roller or drum 2 at a transfer station wherein a transfer nip 2*a* is formed between roller 18, primary image member 1 and transfer drum 2. The primary image member 1 is cleaned at a cleaning station 14 and reused to form more toner images of different color utilizing development stations 5, 6, 7 and 8. One or more additional images are transferred in registration with the first image transferred to drum 2 to create a multicolor toner image on the surface of transfer drum 2. The primary image member may instead be a drum that is rotated by suitable means. The developer in the development station is of the two-component type that includes magnetic carrier particles coated with an insulative coating and electrically nonconductive or insulative dry toner particles. Other particles may be present in the developer as charge control agents, etc. as is well known. Examples of development stations are described in U.S. Pat. No. 5,196,887, the contents of which are incorporated herein by reference. However, the details of such stations are not critical to this invention. The toner particles are preferably from about 3 microns to about 20 microns in size, mean volume weighted diameter. The carrier particles are preferably from about 25 microns to about 150 microns in size.

The multicolor image is transferred to a receiving sheet such as paper or plastic which has been fed from supply 10 into transfer relationship with transfer drum 2 at a transfer nip of a transfer station 25 where the receiving sheet is brought into pressure contact with the image on the drum 2. The receiving sheet is transported from transfer station 25 by a transport mechanism 13 to a fuser 11 where the toner image is fixed by conventional means. The receiving sheet is then conveyed from the fuser 11 to an output tray 12. Alternatively, when operated in a monocolor mode, a single monocolor image is transferred to drum 2 from the member 1 and then transferred to a receiving sheet. The intermediate transfer member may be a belt instead of a drum.

The toner image is transferred from the primary image member 1 to the intermediate transfer drum 2 in response to an electric field applied between the core of drum 2 and a conductive electrode forming a part of primary image member 1. The multicolor toner image is transferred to the receiving sheet at a transfer station 25 in response to an electric field created between a backing roller 26 and the transfer drum 2. Thus, transfer drum 2 helps establish both electric fields. As is known in the art, a polyurethane roller containing an appropriate amount of antistatic material to make it of at least intermediate electrical conductivity can be used for establishing both fields. Typically, the polyurethane or other elastomer is a relatively thick layer; e.g. one-quarter inch thick, which has been formed on an aluminum base. Typically, the electrode buried in primary image member 1 is grounded for convenience in cooperating with the other stations in forming the electrostatic and toner images. If the toner is a positively-charged toner, an electrical bias $V_{ITM}$ applied to intermediate transfer drum 2 of typically −300 to −1,500 volts will effect substantial transfer of toner images to transfer drum 2. To then transfer the toner image onto a receiving sheet at transfer station 25, a bias, e.g., of −2,000 volts or greater negative voltages is applied to backing roller 26 to again urge the positively charged toner to transfer to the receiving sheet. Schemes are also known in the art for changing the bias on drum 2 between the two transfer locations so that roller 26 need not be at such a high potential. Transfers to the ITM and to the receiver sheet are made with the temperature of the toner below the softening point of the toner, i.e., below Tg the glass transition temperature.

As noted in Rimai et al U.S. Pat. No. 5,084,735, image artifacts are reduced if the intermediate transfer member (ITM) has a surface of material having release characteristics that are such that the toner prefers or adheres more readily to such surface than to that primary image member 1 and less readily to the surface than the receiving sheet.

The ITM drum 2 has a polyurethane base layer upon which a thin skin is coated or otherwise formed having the desired release characteristics. The polyurethane base layer preferably is supported upon an aluminum core. The thin skin may be a thermoplastic and should be relatively hard, preferably having a Young's modulus in excess of $5\times10^7$ Newtons per square meter to facilitate release of the toner to ordinary paper or another type of receiving sheet. The base layer is preferably compliant and has a Young's modulus of $10^7$ Newtons per square meter or less to assure good compliance for each transfer.

When operated in the multicolor mode, a cleaning apparatus 130 for cleaning the ITM is moved or pivoted away from the drum 2 to allow transferred images to the ITM to be built up in registration with each other. After transfer, the ITM is then cleaned of remnant toner and other particles by pivoting the cleaner apparatus 130 so that a brush to be described below is in contact with the ITM or drum 2. In the monocolor mode, the cleaning apparatus may be allowed to remain in its cleaning position or in contact with the drum 2.

Figure 2:
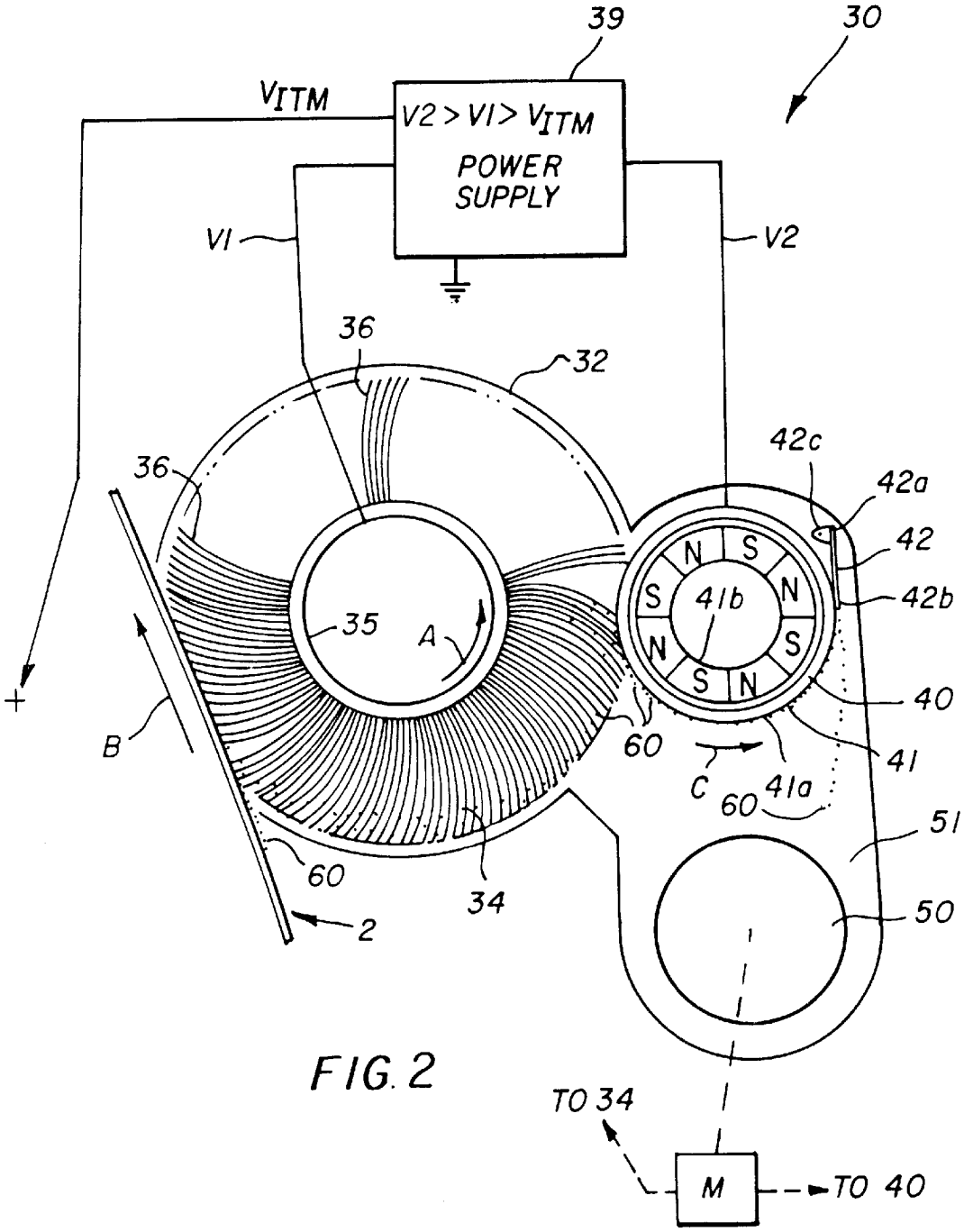
FIG. 2 is a side elevation schematic showing a cleaning apparatus as described in the referenced applications.

Reference will now be made to FIG. 2 where a cleaning apparatus is illustrated of the type described in the referenced applications. The cleaning brush apparatus 30 of FIG. 2 comprises a housing 32 which encloses a fiber cleaning brush 34 having conductive fibers 36 which through an opening in the housing engage the ITM 2. In order to improve cleaning an optional cleaning-assist charger 61 may be provided, upstream of the area where the cleaning brush contacts the ITM, to charge the remnant toner so that its charge polarity and magnitude are optimum to assist its removal from the ITM by the conductive fiber cleaning brush.

The brush 34 is supported on a core 35 which is driven in rotation by a motor M or other motive source to rotate in the direction of the arrow A as the ITM is moved in the direction shown by arrow B. Alternatively, the direction of rotation of the brush may be the reverse direction than that shown. As the brush rotates, untransferred toner particles 60 and other particulate debris, such as carrier particles and paper dust, on the ITM 2 are mechanically scrubbed from the ITM and picked up into the fibers 36 of the brush. The items illustrated in the figures are generally not shown to scale to facilitate understanding of the structure and operation of the apparatus. In particular, the brush fibers are shown much larger to scale than other structures shown in FIG. 2. In addition to mechanical scrubbing, an electrical bias is applied to the cleaning brush from power supply 39. The electrical bias V1 of the power supply 39 to the cleaning brush is, as will be more fully explained below, inductively, and not conductively, coupled to the brush fibers 36. The voltage V1 is greater than the voltage bias $V_{ITM}$ applied to the ITM. The polarity of the voltage on the brush fibers is such as to electrostatically attract toner 60 to the brush fibers. The toner particles 60 entrained within the fibers are carried to a rotating detoning roller 40 which is electrically biased by power supply 39 to a higher voltage level V2 than the voltage level VI; i.e., the voltage level V2 is of a level to electrostatically attract the toner particles in the brush to the detoning roller. Assuming a positively charged toner image, as an example, the toner image may be attracted to the ITM which is biased to the voltage bias $V_{ITM}$ in the range of about −300 volts to about −1500 volts. The cleaning brush, in such an example would be biased to a potential V1 which is in the range of about −550 volts to about −1750 volts. The detoning roller in this example would be biased to a potential V2 which is in the range of about −800 volts to about −2000 volts. In considering relationships of voltage $V2>V1>V_{ITM}$, the absolute values of the voltages are implied.

The toner particles 60 are electrostatically attracted to the outer surface 41 of the detoning roller 40. The surface 41 of detoning roller 40 is rotated in the direction of arrow C by a drive from motor M counter to that of brush fibers or alternatively in the same direction. The toner particles are carried by the surface 41 of the detoning roller towards a stationary skive blade 42 which is supported as a cantilever at end 42*a* so that the scraping end 42*b* of the blade 42 engages the surface 41 of the detoning roller. Toner particles scrubbed from the surface are allowed to fall into a collection chamber 51 of housing 32 and periodically a drive such as from motor M or other motive source is provided to cause an auger 50 or other toner transport device to feed the toner to a waste receptacle. Alternatively, the collection receptable may be provided attached to housing 32 so that particles fall into the receptable directly and the auger may be eliminated.

In order to ensure intimate contact between the detoning roller outer surface 41 and the skive blade 42, a permanent magnet is stationarily supported within the hollow enclosure of the detoning roller. The skive blade is made of a metal such as ferromagnetic steel and is of thickness of less than 0.5 mm and is magnetically attracted by the magnet to the detoning roller surface 41. This effectively minimizes the tendency of the blades end 42*b* to chatter as the surface 41 travels past the blade end 42*b* and thus provides more reliable skiving of the toner and therefore improved image reproduction.

The skive blade extends for the full working width of the detoning roller surface 41 and is supported at its end 42*b* by ears 42*c* which are soldered to the blade. A pin extends through a hole in the ear portion to connect the skive to the housing. The detoning roller preferably comprises a toning or development roller as used in known SPD-type development stations which includes a core of permanent magnets surrounded by a metal sleeve 41*a* whose outer surface is roller surface 41. As a detoning roller, the magnetic core is formed of a series of alternately arranged poles (north-south-north-south, etc.) permanent magnets 41*b* that are stationary when in operation. Sleeve 41*a* is formed of polished aluminum or stainless steel and is electrically conductive but nonmagnetic so as not to reduce the magnetic attraction of the skive blade to the magnets in the core. The sleeve is driven in rotation in the direction of arrow C and is electrically connected to potential V2. The use of a toning roller for the detoning roller as shown provides a magnet not only adjacent the skive blade but also adjacent the fiber brush. During development of the image, small amounts of magnetic carrier particles have escaped from the development stations 5–8 and been carried by the primary image member. Some may be transferred to the ITM2. These particles may be removed from the ITM 2 by the fiber brush. The carrier particles represent a minor amount relative to the remnant toner and are removed from the fiber brush by magnetic attraction to the detoning roller. The magnetic core may be allowed to rotate freely to have the core magnets positioned through a rotational self-adjustment to provide maximum attraction of the skive blade to the detoning roller. The core can then be locked in place or allowed to maintain its self-adjusted position. The detoning roller may also comprise a roller having a rotating conductive sleeve with fewer internal magnets than the development roller since the presence of magnets is only desirable at locations needed to attract carrier particles from the brush to the detoning roller and to attract the skive blade to the sleeve of the detoning roller.

Figure 7:
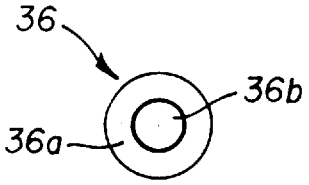
FIG. 7 illustrates a transverse cross-sectional view of a fiber, greatly enlarged and not to scale, the fibers being a preferred form for use in the cleaning apparatus of the invention.

With reference now to FIG. 7, a transverse cross-section of a fiber of the brush 34 is illustrated. The fibers preferably each include a non-conductive polymer peripheral portion 36*a* and a conductive central core portion 36*b*. A preferred fiber is commercially available from E.I. duPont de Nemours & Company, Inc. as Nega-stat™ 190 which is a bi-component fiber having a carbon core that is encapsulated by a dacron polyester sheath. Other suitable fibers include one from BASF Corporation under the designation F-7405 and known as Resistat. The latter fibers are formed of nylon and rendered conductive in the central core portion by impregnation with carbon black or other conductive particles. As is known in the art of fiber manufacture, carbon black is melt spun with the filamentary polymer, such as nylon, in an amount sufficient to render the electrical resistivity of the fiber core from about $10^9$ ohm-centimeters or less. The core and sheath are formed simultaneously and the sheath portion of the fiber has a resistivity of about $10^{12}$ ohm-centimeters or greater and not does not contain sufficient amount of carbon black particles to provide conductivity. However, in accordance with the broader aspects of the invention, the fibers need not be conductive only at the core.

Figure 8A:
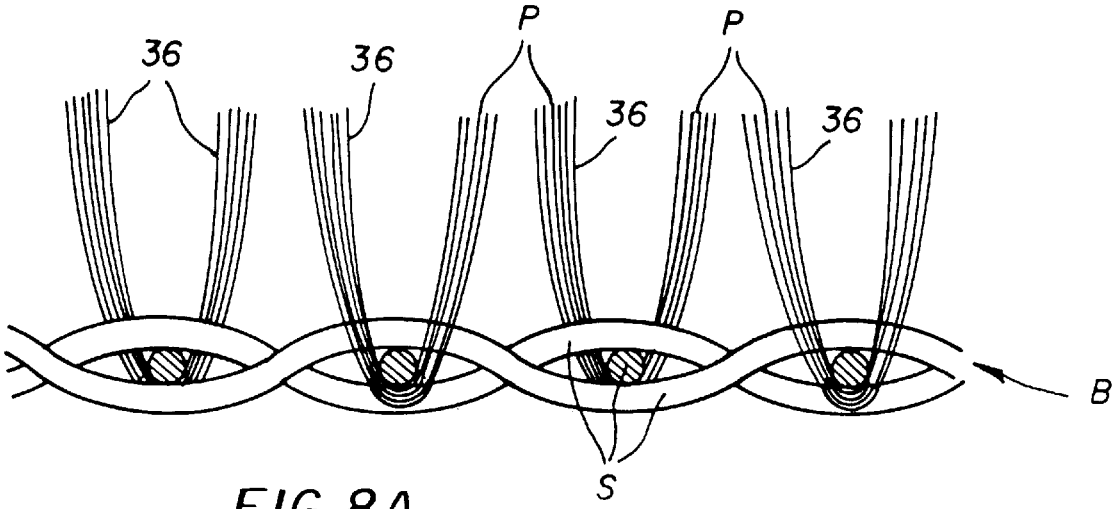
FIGS. 8 illustrate respectively a side elevation and a plan view in cross-section of one example of a weaving technique used in the cleaning apparatus of the invention.
Figure 8B:
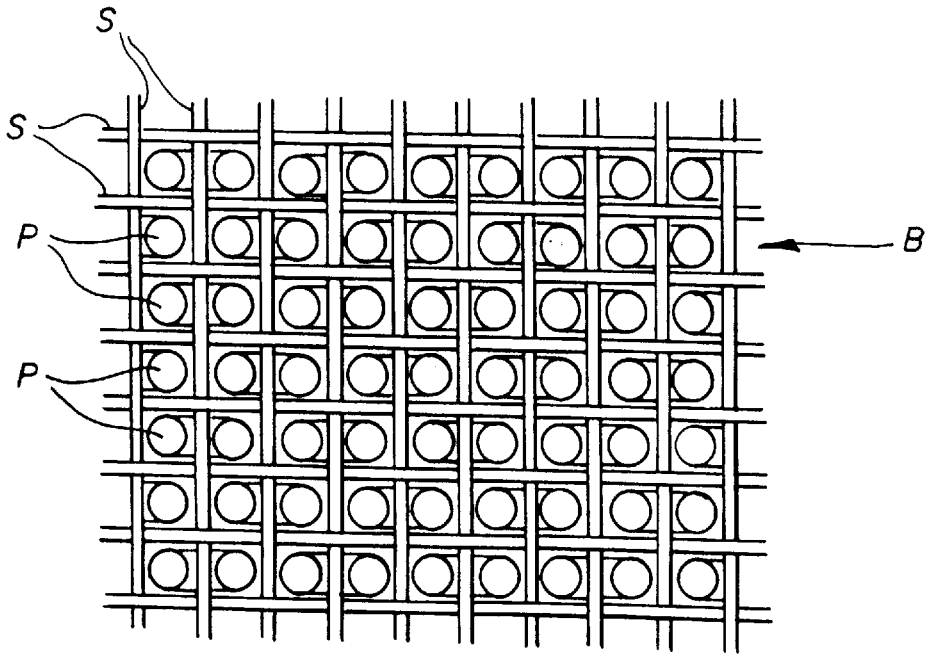

With reference now to FIGS. 8A and 8B, there is shown one example of weaving of the fibers 36 into a fabric-based backing strip B to form a pile P as is well known. The fibers S of the backing strip B are also electrically conductive or at least some are conductive. The electrical conductivity of the fibers, S, extends to the periphery of these fibers S. This provides an electrically conductive mat into which the conductive core, insulating sheathed fibers are woven. The conductive mat furnishes a means of inductively charging the conductive cores of pile fibers P without making ohmic contact to them. Alternatively, and preferably, the fibers S of the backstrip B, whether conductive or nonconductive, are coated with a carbon-filled conductive latex paint. Other weaving techniques for forming the pile P may be used. Additionally, not all the fibers in the pile P need be identical as long as there is no or minimal electrical conductivity or no ohmic contact between the fabric backing and the conductive cores of the fibers in the pile.

Figure 9:
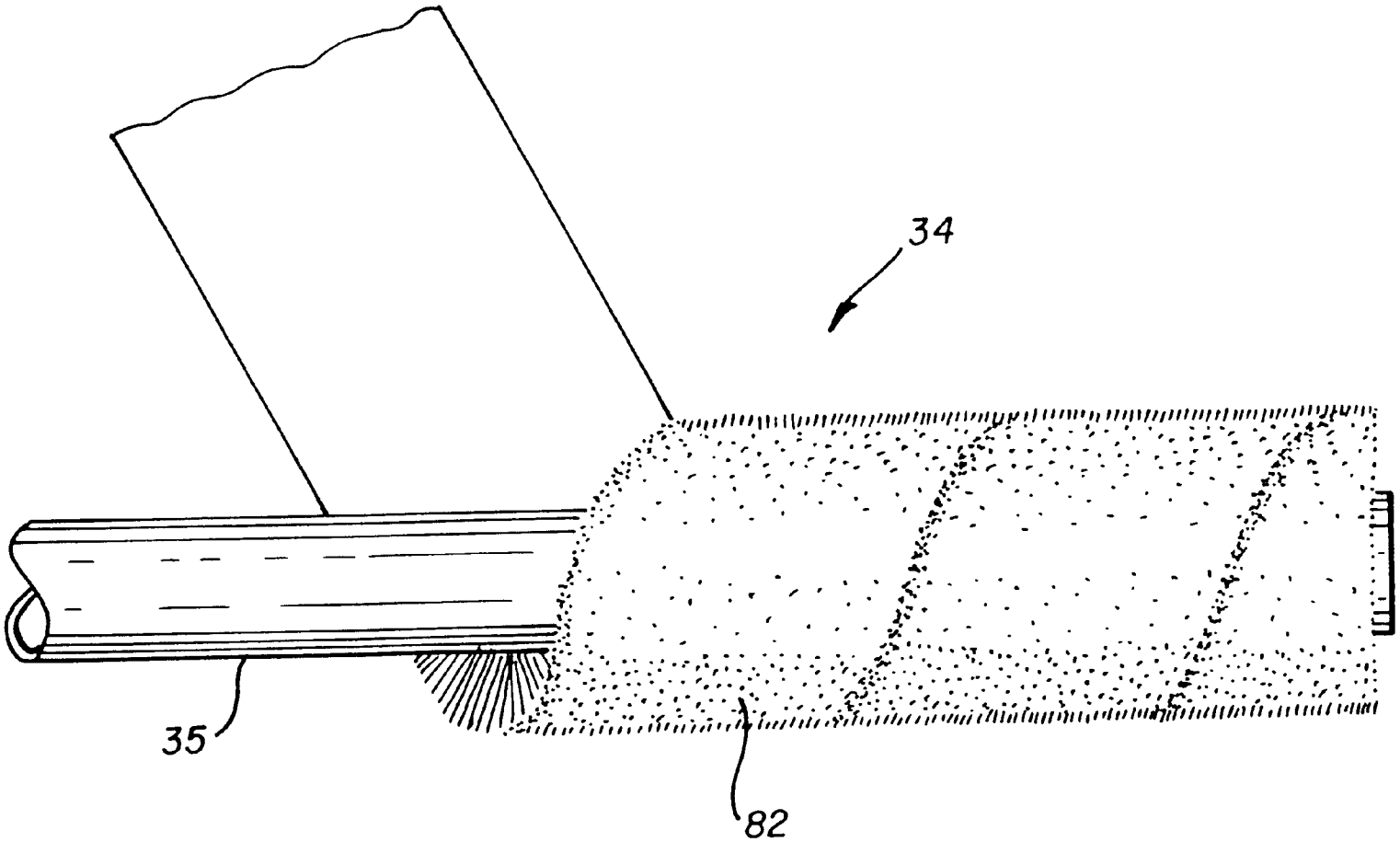
FIG. 9 is a view illustrating one technique for mounting the cleaning brush forming a part of the apparatus of the invention.

With reference now to FIG. 9, the fiber brush may be fabricated from the conductive pile by cutting the pile into strips 82 as shown and winding the strips onto a cylindrical core 35 to form a cylindrical brush. The backing as noted above of the fabric strip is conductive and is glued to the core. At the edges of the core 35 conductive tape or some electrical conductor may be provided in electrical contact with the backing strip. The tape may be then seated against the edges of the brush core 35 to provide access for applying an electrical bias V1 to the backing strip by power supply 39.

Typically, the cleaning brush has an outside diameter of about ½ to about 3 inches (about 1.2 cm to about 7.5 cm). The fiberfill density is of the order of 20,000 fibers to 150,000 fibers per square inch and preferably 75,000 to 100,000 of from about 5 to about 10 denier per filament fiber. The pile height of the brush may be from about 2 millimeters to about 20 millimeters and preferably is 3 mm. The fiber pile is thus not shown to scale in the various figures to facilitate understanding of the invention.

In lieu of using the above described fibers, the invention contemplates the use of yarn-type fibers wherein a conductive fiber core is wrapped with a nonconductive sheath of microfibers. Fibers made of materials other than nylon may also be used.

In operation of the apparatus of FIGS. 1 and 2, toner images formed on primary image member 1 are transferred to ITM 2 by electrostatic attraction using applied fields as well as other forces such as the above-noted preferential adhesion. As may be seen in FIG. 1, an electrical bias is imparted to the ITM (or to the primary image member 1 or both) to establish an electrical field in the transfer nip 2*a* suited for transfer. The transfer member (ITM2) has a compliant layer that is semiconductive which is defined as having resistivity from about $10^8$ ohm-cm to about $10^{10}$ ohm-cm. A very thin hard overcoat or covering layer may cover the compliant layer and be relatively more insulating than the compliant layer but the effect of both layers in combination provides electrical conductivity of an intermediate level (resistivity of about $10^8$ ohm-cm to about $10^{10}$ ohm-cm) as is known in the prior art such as described in U.S. Pat. Nos. 5,084,735; 5,187,526 and 5,370,961. The conductive fiber brush engages the ITM 2 after transfer of the images(s) to a receiver sheet to remove untransferred toner remaining on the surface of ITM2. The cores of the conductive fibers as described above are electrically biased to a higher potential than that provided to ITM 2. However, because the fibers bend when engaging the ITM 2, the insulating periphery of each of the fibers tends to engage the ITM 2 rather than the conductive core. This allows the fiber to establish an electrical field suitable for attracting toner to the brush with minimal current flow between brush fibers and ITM 2. Similarly and with reference to FIG. 2, both the brush fibers and detoning roller 40 are provided with different electrical biasing to attract toner from the brush to the detoning roller. Again, even though the surface 41 of the detoning roller 40 is a metal and highly electrically conductive, there is a minimal electrical current provided by the power supply 39 because contact of the brush fibers with the surface 41 of the detoning roller is primarily with the insulating periphery 36*a* of each fiber rather than the conductive core 36*b* due to the bending of the fibers 36 against surface 41. Because of the minimum current flow, higher detone fields may be provided to effect greater cleaning of the brush by the detone roller.

As noted above and determined by the inventors herein, congregation of iron carrier particles tends to occur adjacent to the edge of the skive and thereby creates premature wear of the skive blade. To overcome this problem, the following modified cleaning brush apparatus are described.

Figure 3:
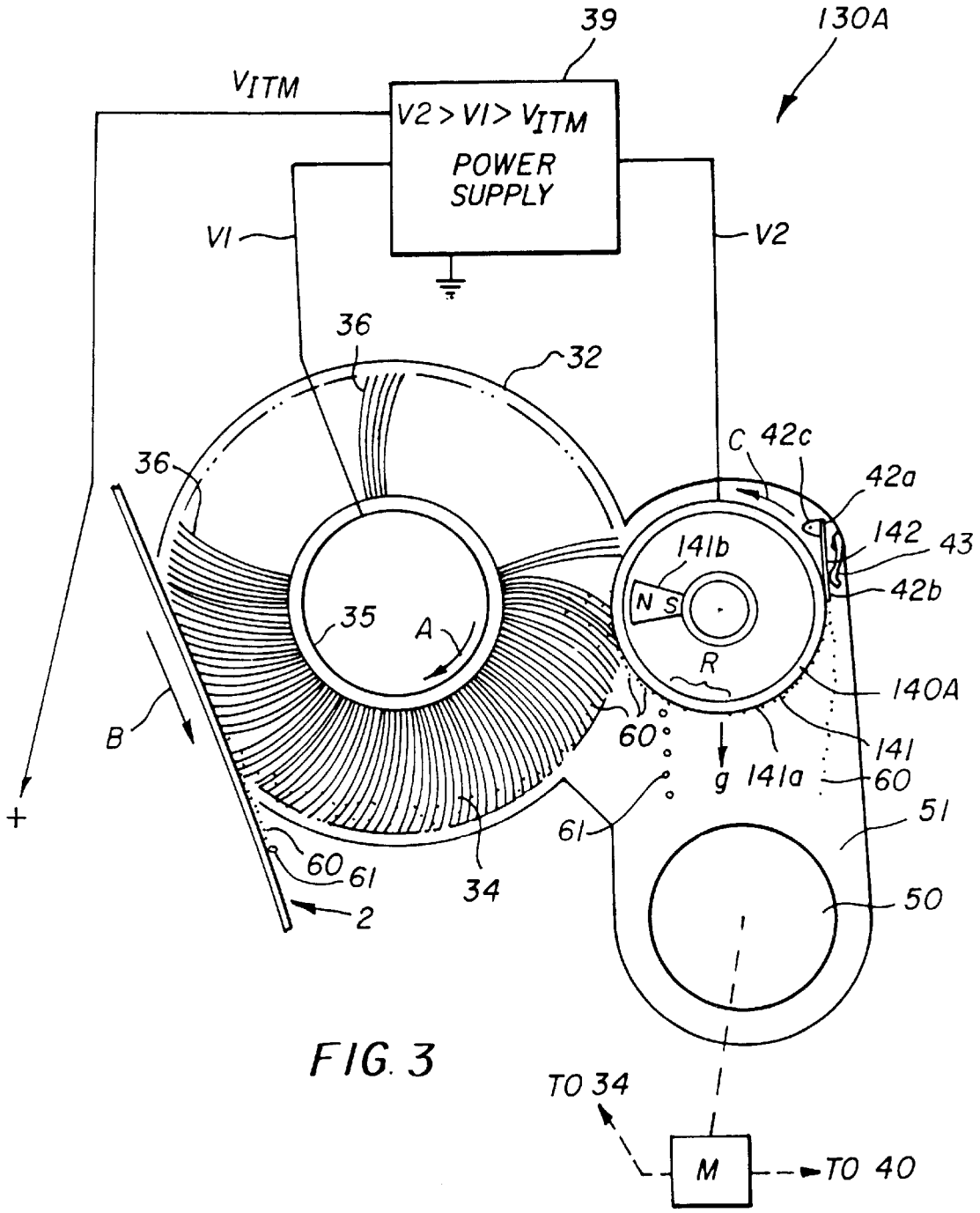
FIG. 3 is a side elevation schematic showing a cleaning apparatus in accordance with a first embodiment of the invention.

With reference now to FIG. 3 wherein similar part numbers to that of FIG. 2 refer to similar structure. In FIG. 3, the cleaning apparatus 130A differs from that of FIG. 2 in that the detoning roller 140A includes a core with narrow segment 141*b* of permanent magnet that is stationarily positioned to apply a magnetic field of approximately 180 gauss at the surface 141 of the detoning roller proximate to where the fiber brush 34 contacts the surface 141 of shell or sleeve 141*a*. There is thus almost no magnetic field (or at least an insufficient field to hold the carrier to the detoning roller) in the region R of the outer surface 141*a* which is about 70 to 120 degrees from the region of the maximum magnetic field. The geometry of the system is such that the force of gravity g acts at a location generally perpendicular to the direction of the maximum magnetic field provided by the magnetic core segment 141*b*. Thus, carrier particles 60 removed from the toner image bearing member such as ITM 2 by the fiber brush 34 are magnetically attracted to the detoning roller but most of the magnetic carrier particles 61 when removed from the magnetic field due to rotation of the shell 141*a* in the direction of arrow C tend to leave the shell at the region R and fall to the collection chamber 51. Two other factors assist in moving the carrier particles away from the position of the magnet and from the roller surface: 1) the mechanical action of the cleaning brush fibers 36 where they interact with the detoning roller force the carrier particles away from the magnetic field that attracted them to the detoning roller, 2) centrifugal forces on the carrier particles moving with the detoning roller's surface 141, which is turning, for example, at 400 RPM, assist the carrier particles in leaving the roller surface in the low magnetic field region. With this modified system the carrier particles will still be removed from the cleaning brush but will now mostly be removed from the detoning roller before they reach the skive blade 142. There is thus prevented premature wear and failure of the blade to remove toner particles. If any carrier particles do reach the skiving blade, they will not be attracted to that position by any magnetic force and will be effectively removed by the blade. The skive blade 142 is made from a non-magnetic material such as stainless steel or beryllium copper, and is held against the detoning roller surface 141 by spring tension provided by spring 43. The toner particles 60 and any carrier particles that continue to be carried by the detoning roller surface 141 are removed by the skive blade 142 and also fall into the collection chamber. There is thus avoided the collection of iron carrier particles near the edge of the skive blade which was noted to cause increased wear of the blade.

Figure 4:
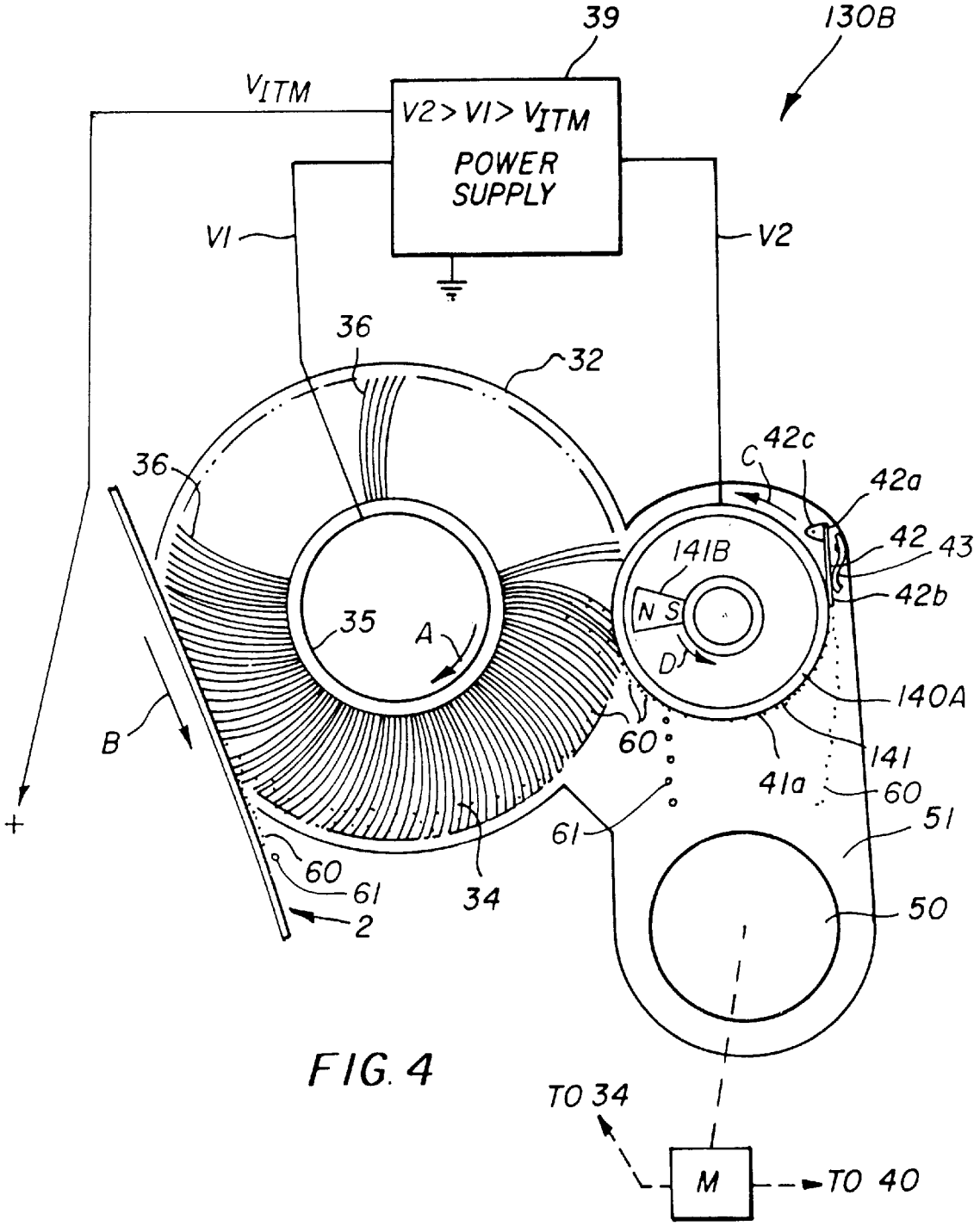
FIG. 4 is a side elevation schematic showing a cleaning apparatus in accordance with a second embodiment of the invention.

Description will now be provided of the next embodiment of the invention with reference being made to the illustration in FIG. 4. FIG. 4 is identical to FIG. 3 except that the magnetic core segment 141*b* rotates as shown by arrow D in the same direction as the shell 141*a* and preferably not at the same angular velocity.

The rotating core magnet segment 141*b* in FIG. 4 will transport the carrier particles around the detoning roller to the skive blade. Since the skive blade is non-magnetic the carrier particles will move up the blade until the magnetic field reduces, due to the continued motion of the core and the increasing spacing between the magnetic core and the magnetic carrier particles on the skive blade, at which point the carrier particles fall completely away from the skive blade.

The rotation of the core has been found to be effective in removing carrier particles at rotational rates from 40 to 850 RPM where the diameter of the shell is 1.2 inches and the permanent magnet is about 180 gauss and of relatively narrow width. The magnetic field was measured using a Bell, Model 912 Gaussmeter, which employs a Hall Effect probe, to measure the normal compound of the magnetic field at the detoning roller's surface. At slower rates, the carrier does not fall away as decisively. At higher rates, the magnet may come around before the particles have a chance to fall away from the skive blade under the influence of gravity.

Figure 5:
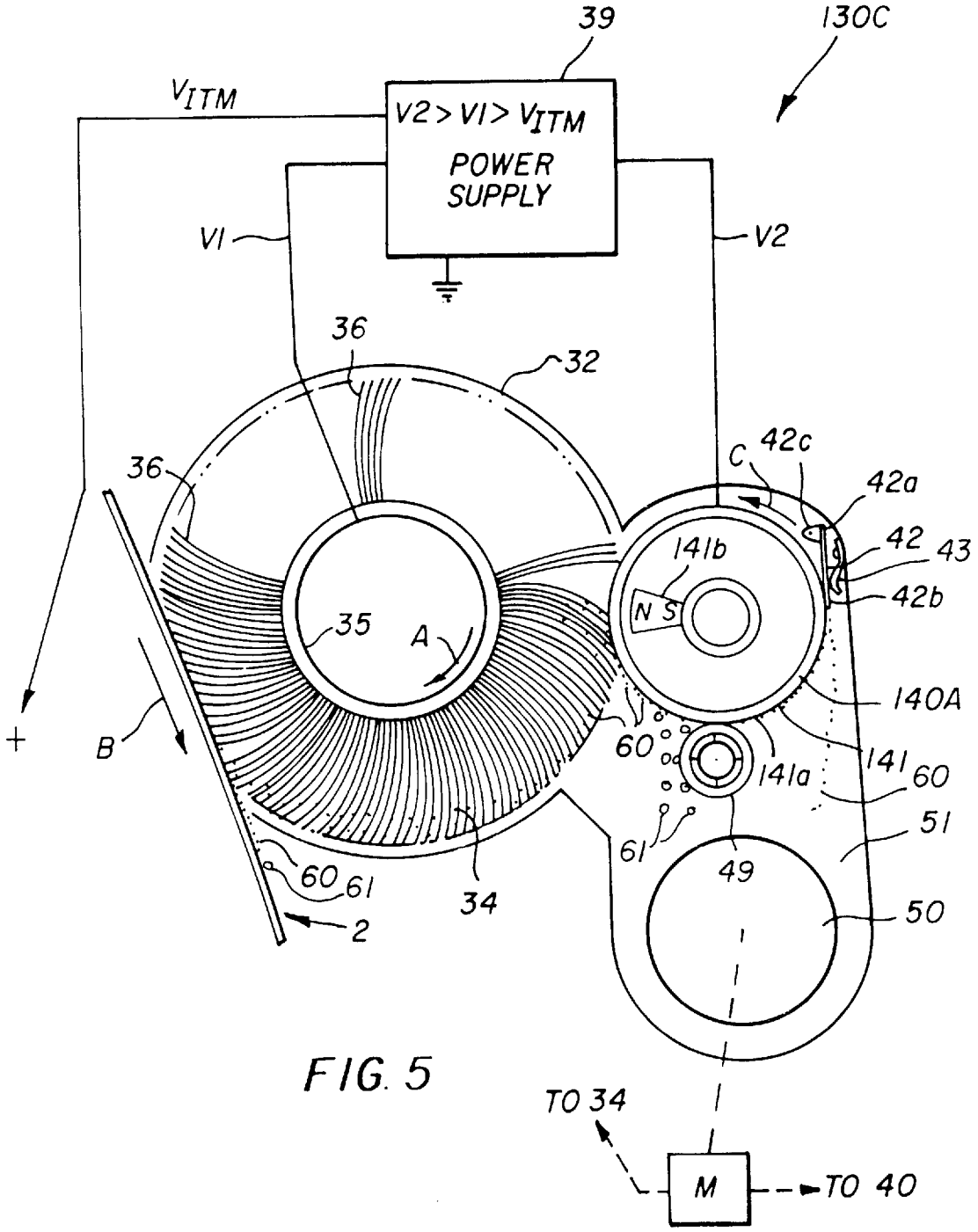
FIG. 5 is a side elevation schematic showing a cleaning apparatus in accordance with a third embodiment of the invention.

In the embodiment of FIG. 5, still another modification is illustrated that is identical to the embodiment of FIG. 3 except that there is additionally added a conventional scavenger roller 49 positioned as shown in FIG. 5. The position of the scavenger roller is between the fiber brush contact area and the skive blade contact area of the detoning roller surface 141. The scavenger roller is positioned near, but out of engagement with, the detoning roller surface 141 to magnetically or electrostatically attract the carrier particles to the scavenger roller. The scavenger roller includes a rotating cylindrical surface to which the carrier particles are attracted to. Where the attraction is by electrostatic attraction, an electrical bias is provided of opposite polarity to that of the carrier particles. Where the attraction is magnetic a non-magnetic shell and magnetic core is provided with rotation provided to either the shell or the core. A drive may be imparted to the surface of the scavenger roller either directly from motor drive M or indirectly by a drive from the detone roller shell. As is known, rubber tires may be provided on ends of the scavenging roller and which engage the detoning roller to cause drive to the detone roller shell to be coupled to the scavenger roller. A skive blade or vacuum may be associated with the scavenger roller to remove carrier particles from the scavenger roller. The scavenger roller thus removes any carrier attached to the detoning roller's surface before it reaches the skive blade 42.

Figure 6:
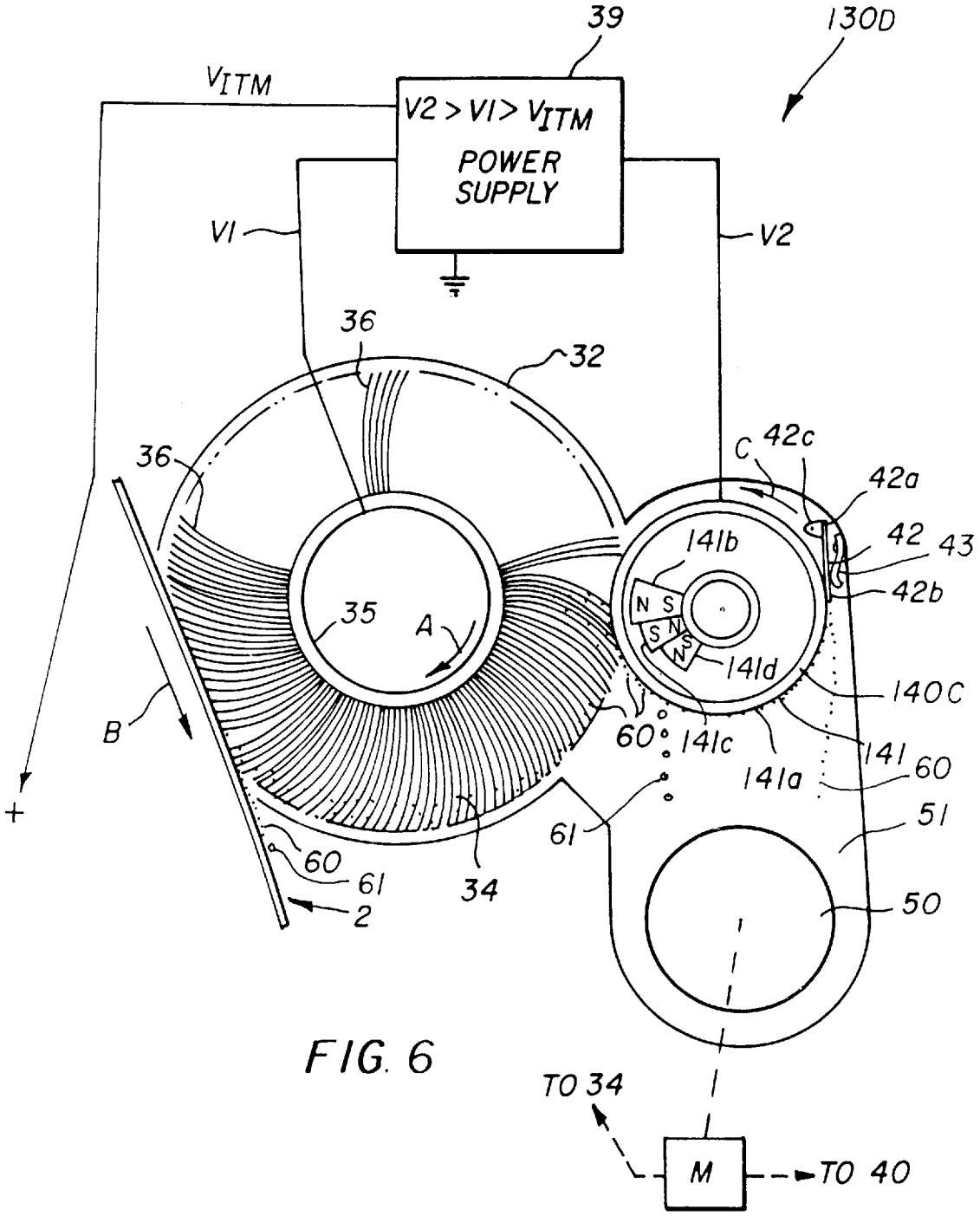
FIG. 6 is a side elevation schematic showing a cleaning apparatus in accordance with a fourth embodiment of the invention.

Still another modification of the detoning roller magnetic core configuration that provides improved performance of the removal of carrier particles from the cleaning system is shown in FIG. 6. This embodiment is identical with FIG. 3 except that two additional stationary permanent magnets 141*c* and 141*d* are provided in the core and these additional magnets positioned near the single magnet 141*b*. The first magnet 141*b*, in this case, is located at the point where the cleaning brush and the detone roller make contact and is stationary also. This is the strongest magnet of the three; as an example, in this case it measures 225 gauss at the outer surface of the detoning roller. The second magnet 141*c* is located adjacent to and downstream of the first magnet. The polarity of the pole nearer the shell of magnet 141*c* is of opposite polarity to the polarity of the pole nearer the shell of the first magnet 141*b* and the magnetic strength of the pole of the magnet 141*c* is less, in this case, 180 gauss measured at the outer surface of the detoning roller surface. The third magnet 141*d* is located adjacent to and downstream of the second magnet. The polarity of the pole nearer the shell of the third magnet is of opposite polarity to the polarity of the pole nearer the shell of the second magnet 141*c* with the field of the magnet 141*d* as measured at the outer surface of the detoning roller surface reduced even further, in this case, 55 gauss. Downstream refers to direction of the rotational movement of the detoning roller's surface 141*a*.

In operation of the embodiment of FIG. 6, carrier particles entrained in the cleaning brush are attracted to the detoning roller by the first and strongest magnet 141*b* of the detoning roller core. The particles are carried counter clockwise by the combined effects of the cleaning brush fibers and the rotational motion of the detoning roller surface 141. Since the magnetic poles adjacent to the detoning roller surface alternate in polarity, the normal component of the magnetic field decreases to zero between each pair of magnets but the tangential component is maximized. This condition, combined with sequentially decreasing fields provided by the decreasing magnet strength, encourages the carrier to leave the detone roller surface tangentially due to centrifugal forces caused by the particles velocity mass radius of rotation and perhaps the tangential component of the magnetic field.

Experiments done with this magnetic configuration with rotational rates of the detoning roller ranging between 100 and 400 RPM, and with the field strengths given above, removed all carrier particles from the detoning roller before they reached the skive blade.

Although the invention has been disclosed with specific reference to cleaning of an intermediate transfer member, the invention is also applicable to cleaning of transfer rollers and photoconductors and other members.

The term non-magnetic for a material implies substantially or almost no meaningful response to the magnetic fields associated with the operation of the apparatus described herein.

The invention has been described in detail with particular reference to preferred embodiments thereof, but it will be understood that variations and modifications can be effected within the spirit and scope of the invention.

What is claimed is:

1. An electrostatographic reproduction apparatus comprising:

a toner bearing member supporting a remnant of a toner image comprised of an amount of insulative toner particles and also supporting a minor amount relative to the amount of toner particles in the remnant image of escaped magnetic carrier particles; and a cleaning apparatus including a fiber cleaning brush including fibers in contact with the toner bearing member in scrubbing the member to remove remnant toner particles and carrier particles, a rotating detoning roller having an electrically conductive surface in contact with the fibers of the fiber brush, the detoning roller including a permanent magnet located beneath the conductive surface for providing a magnetic field where the fibers engage the detoning roller and attracting escaped carrier particles to the detoning roller, an electrical bias on the conductive surface of the detoning roller for electrostatically attracting toner particles to the conductive surface, a skive blade of substantially non-magnetic material, the skive blade engaging the conductive surface at a location remote from where the fibers engage the detoning roller; and wherein the permanent magnet is stationary and wherein magnetic field strength at the location where the skive blade engages the conductive surface is substantially lower than magnetic field strength where the fibers contact the conductive surface.

2. The apparatus of claim 1 wherein a permanent magnet within the detoning roller is located only proximate a location where the detoning roller engages the fibers.

3. The apparatus of claim 1 wherein at least some of the fibers are electrically conductive and an electrical bias is provided to the fibers to electrostatically attract remnant toner particles to the brush.

4. The apparatus of claim 3 wherein the said at least some of the fibers are conductive brush fibers that are each comprised of an electrically conductive core and an electrically insulative surrounding portion.

5. The apparatus of claim 1 wherein the brush rotates so that the fibers move carrier particles in the direction of the force of gravity.

6. The apparatus of claim 1 wherein the permanent magnet comprises three permanent magnets of different magnetic strengths, the magnetic strengths weakening in a direction of rotation of the surface of the detoning roller and a polarity of a magnet between the strongest magnet and the weakest magnet being opposite in polarity to that of the strongest and weakest magnets.

7. The apparatus of claim 6 wherein the detoning roller rotates within a range of about 100 to about 400 revolutions per minute.

8. The apparatus of claim 1 and including a scavenging roller positioned proximate the surface of the detoning roller for removing carrier particles on the detoning roller upstream of the location where the skive blade contacts the detoning roller.

9. An electrostatographic reproduction apparatus comprising:

a toner bearing member supporting a remnant of a toner image comprised of an amount of insulative toner particles and also supporting a minor amount relative to the amount of toner particles in the remnant image of escaped magnetic carrier particles; and a cleaning apparatus including a fiber cleaning brush including fibers in contact with the toner bearing member and scrubbing the member to remove remnant toner particles and carrier particles, a rotating detoning roller having an electrically conductive surface in contact with the fibers of the fiber brush, the detoning roller including a permanent magnet located beneath the conductive surface for providing a magnetic field where the fibers engage the detoning roller and attracting escaped carrier particles to the detoning roller, an electrical bias on the conductive surface of the detoning roller for electrostatically attracting toner particles to the conductive surface, a skive blade of substantially non-magnetic material, the skive blade engaging the conductive surface at a location remote from where the fibers engage the detoning roller and wherein the permanent magnet in the detoning roller establishes a magnet field along only a narrow segment of the detoning roller surface and the permanent magnet rotates in the direction of rotation of the surface of the detoning roller.

10. The apparatus of claim 9 wherein at least some of the fibers are electrically conductive and an electrical bias is provided to the fibers to electrostatically attract remnant toner particles to the brush.

11. The apparatus of claim 10 wherein the said at least some of the fibers are conductive brush fibers that are each comprised of an electrically conductive core and an electrically insulative surrounding portion.

12. The apparatus of claim 9 wherein the permanent magnet rotates at a rate between about 40 and about 850 revolutions per minute.

13. A cleaning method for use in an electrostatographic reproduction apparatus, the method comprising:

providing a toner bearing member supporting a remnant of a toner image comprised of an amount of insulative toner particles and a minor amount relative to the amount of toner particles in the remnant image of magnetic carrier particles;

scrubbing the member to remove remnant toner particles and carrier particles with a fiber cleaning brush including fibers in contact with the toner bearing member;

rotating a detoning roller having a rotating surface in contact with the fibers of the fiber brush, the detoning roller including a permanent magnet located beneath the surface and providing a magnetic field strength sufficient for attracting escaped carrier particles to the detoning roller's surface;

establishing an electrical bias that attracts toner particles to the detoning roller's surface;

biasing a skive blade of non-magnetic material into engagement with the detoning roller's surface, the skive blade removing toner particles from the detoning roller's surface; and wherein the permanent magnet is stationary and wherein magnetic field strength at a location where the skive blade engages the detoning roller's surface is substantially less than the magnetic field strength used for attracting carrier particles to the detoning roller's surface.

14. The method of claim 13 wherein the fibers are electrically conductive and an electrical bias is provided to the fibers to electrostatically attract remnant toner particles to the brush.

15. The method of claim 14 wherein the conductive fibers are each comprised of an electrically conductive core and an electrically insulative surrounding portion.

16. The method of claim 14 wherein the detoning roller's surface is conductive.

17. The method of claim 13 wherein the permanent magnet comprises three permanent magnets of different magnetic strengths, the magnetic strengths weakening in a direction of rotation of the surface of the detoning roller and a polarity of a magnet between the strongest magnet and the weakest magnet being opposite in polarity to that of the strongest and weakest magnets.

18. The method of claim 13 and including operating a scavenging roller positioned proximate the surface of the detoning roller to remove carrier particles on the detoning roller at a location that is upstream of the location where the skive blade contacts the detoning roller in a direction of rotation of the detoning roller.

19. A cleaning method for use in an electrostatographic reproduction apparatus, the method comprising:

providing a toner bearing member supporting a remnant of a toner image comprised of an amount of insulative toner particles and a minor amount relative to the amount of toner particles in the remnant image of magnetic carrier particles;

scrubbing the member to remove remnant toner particles and carrier particles with a fiber cleaning brush including fibers in contact with the toner bearing member;

rotating a detoning roller having a rotating surface in contact with the fibers of the fiber brush, the detoning roller including a permanent magnet located beneath the surface and attracting escaped carrier particles to the detoning roller's surface;

establishing an electrical bias that attracts toner particles to the detoning roller's surface;

biasing a skive blade of non-magnetic material into engagement with the detoning roller's surface, the skive blade removing toner particles from the detoning roller's surfacer; and wherein the permanent magnet rotates at a rate between 40 and about 850 revolutions per minute.

20. The method of claim 19 wherein the detoning roller rotates within a range of about 100 to about 400 revolutions per minute.

21. An electrostatographic reproduction apparatus comprising:

a toner bearing member supporting a remnant of a toner image comprised of an amount of insulative toner particles and also supporting a minor amount relative to the amount of toner particles in the remnant image of escaped magnetic carrier particles;

a cleaning apparatus including a fiber cleaning brush including fibers in contact with the toner bearing member and scrubbing the member to remove remnant toner particles and carrier particles, a rotating detoning roller having a surface in contact with the fibers of the fiber brush, the detoning roller including a stationary permanent magnet located beneath the surface for providing a magnetic field where the fibers engage the detoning roller and attracting escaped carrier particles to the detoning roller, an electrical field for electrostatically attracting toner particles to the surface, a skive blade of substantially non-magnetic material, the skive blade engaging the surface at a location remote from where the fibers engage the detoning roller; and wherein magnetic field strength at the location where the skive blade engages the surface is substantially lower than magnetic field strength where the fibers contact the surface.

* * * * *